United States Patent [19]

Cole et al.

[11] 4,009,094

[45] Feb. 22, 1977

[54] STABILIZING PYROLYSIS NAPHTHA

[75] Inventors: Edward L. Cole, Fishkill; John T. Nolan, Jr., Wappingers Falls, both of N.Y.

[73] Assignee: Texaco Inc., New York, N.Y.

[22] Filed: Jan. 9, 1975

[21] Appl. No.: 539,759

[52] U.S. Cl. ..... 208/48 AA; 208/255; 208/53; 208/78; 208/103; 208/131; 208/85

[51] Int. Cl.[2] ..... C10G 9/14; C10G 35/02

[58] Field of Search ..... 208/131, 255, 48 AA

[56] References Cited

UNITED STATES PATENTS

| | | | |
|---|---|---|---|
| 1,969,047 | 8/1934 | Smith | 208/255 |
| 2,081,218 | 5/1937 | Burk | 208/131 |
| 2,717,865 | 9/1955 | Kimberlin et al. | 208/131 |
| 3,389,074 | 6/1968 | Biehl | 208/131 |

*Primary Examiner*—Herbert Levine
*Attorney, Agent, or Firm*—T. H. Whaley; C. G. Ries; Douglas H. May, Jr.

[57] ABSTRACT

Pyrolysis naphtha is contacted with a residuum hydrocarbon charge stock under process conditions suitable for delayed coking of said residuum hydrocarbon charge. Unstable olefinic and diolefinic components of said pyrolysis naphtha are reduced in the product naphtha. Such conversion of unstable olefin and diolefin components is accomplished without substantial conversion of aromatic components of said pyrolysis naphtha.

8 Claims, No Drawings

STABILIZING PYROLYSIS NAPHTHA

BACKGROUND OF THE INVENTION

1. Field of the Invention

The present invention relates to pyrolysis naphtha treating methods for reduction of olefinic and diolefinic unsaturation without a concomitant conversion of aromatic hydrocarbons. More particularly, the present invention relates to a process for treating pyrolysis naphtha in the presence of a residuum hydrocarbon fraction under delayed coking conditions for reduction of reactive olefinic and diolefinic unsaturation and recovery of aromatic components of said pyrolysis naphtha.

Pyrolysis naphtha, such as that obtained as by-products from hydrocarbon cracking processes for production of ethylene, consists of a mixture of highly unsaturated hydrocarbons. Hydrocarbon species represented in pyrolysis naphtha include aromatic hydrocarbons, polynuclear aromatic hydrocarbons, olefin and diolefin substituted aromatic hydrocarbons, olefin hydrocarbons, diolefin hydrocarbons, etc. Commonly, such pyrolysis naphtha may comprise about 70–90 percent of greater hydrocarbons containing aromatic nuclei. Such pyrolysis naphtha has a very high octane blending value, and upon stabilization of reactive olefinic and diolefinic hydrocarbons therein to prevent gum and/or heavy polymer formation such pyrolysis naphtha is particularly useful as a gasoline blending component. Additionally, pyrolysis naphtha is a source of aromatic hydrocarbons which are valuable as solvents, chemical raw materials, etc.

2. Description of the Prior Art

Pyrolysis naphtha, because of its high content of reactive olefinic and diolefinic hydrocarbons, is a highly unstable material and upon exposure to elevated temperatures forms gums, heavy polymers and/or coke-like materials. Consequently, in processes of the prior art for treating such pyrolysis naphtha, particularly hydrotreating processes, process equipment and catalyst tend to become fouled with such gums, heavy polymers and coke. Additionally, gasolines blended employing untreated pyrolysis naphtha have high gum contents which cause engine fouling upon use as a motor fuel. Additionally, for processes wherein aromatics are to be extracted from pyrolysis naphtha, olefinic hydrocarbons interfere with selectivity of the extraction solvent. As a consequence of these fouling problems and solvent selectivity problems it has been found highly preferable in the prior art that pyrolysis naphtha be hydrotreated for saturation of reactive olefinic and diolefinic compounds prior to treatment in other refining processes. However, due to the gum and heavy polymer forming tendency of pyrolysis naphtha upon exposure to elevated temperatures, hydrotreating catalyst exposed to untreated pyrolysis naphtha become rapidly deactivated and fouled.

Processes for treating pyrolysis naphtha prior to hydrotreating or other refining processes are known in the prior art. For example, one process comprises contacting pyrolysis naphtha with clay absorbent for absorption of olefin and diolefin hydrocarbons. Although this process is effective for removal of such olefin and diolefin hydrocarbons, it has a disadvantage in that large amounts of clay absorbents must be either regenerated or disposed of. Furthermore, a substantial portion of the pyrolysis naphtha is lost by absorption into the clay.

Another process for treating pyrolysis naphtha is taught in U.S. Pat. No. 3,400,160; Eng et al (1968). In this treating process, pyrolysis naphtha is contacted with silicaalumina cracking catalyst for polymerization of diolefin hydrocarbons, and subsequently the pyrolysis naphtha-cracking catalyst mixture is passed into a catalytic cracking zone wherein the polymers formed are cracked into lower boiling hydrocarbons. While this process appears effective for reducing the diolefinic unsaturation of pyrolysis naphtha, it is a two-step process and the silica-alumina catalyst must be either regenerated or disposed of in some manner.

Another process for treating pyrolysis naphtha is disclosed in U.S. Pat. No. 3,788,979; Caflisch et al (1974). One embodiment of this process for treating pyrolysis naphtha comprises separating the pyrolysis naphtha into a light fraction and a heavy fraction; cracking the light fraction thus producing monomers corresponding to polymers present in the pyrolysis naphtha; hydrogenating said cracked light fraction for saturation of olefinic hydrocarbons; and recovering a high octane blending component from said hydrogenated product. Another embodiment of this invention comprises cracking full boiling range pyrolysis naphtha; fractionating the cracked product into a light fraction and a heavy fraction; hydrogenating the light fraction for saturation of olefinic hydrocarbons; and recovering a high octane blending component from said hydrogenated product. The first embodiment of the process of this particular patent requires fractionation of the unstable pyrolysis naphtha under conditions which may result in fouling of process equipment such as reboilers and heat exchangers. Additionally, a substantial amount of pyrolysis naphtha, represented by the heavy ends, remains untreated according to the process disclosed.

SUMMARY OF THE INVENTION

Now, according to the method of the present invention, an improved process for treating pyrolysis naphtha prior to subsequent refining processes for reducing olefinic and diolefinic unsaturation is disclosed. The method of the present invention comprises contacting pyrolysis naphtha with a residuum hydrocarbon stock under conditions suitable for delayed coking of said residuum stock; and recovering a naphtha fraction rich in aromatics and substantially reduced in reactive olefinic and diolefinic unsaturation, which naphtha comprises treated pyrolysis naphtha and coker naphtha derived from said residuum hydrocarbon. Delayed coking process conditions under which the residuum hydrocarbon is thermally cracked produce substantial amounts of free radicals which convert reactive olefinic and diolefinic components of said pyrolysis naphtha. Operating conditions for such a delayed coking process include furnace outlet temperatures of from about 800°–1050° F, furnace pressure drops of about 200–2000 psi, coke drum pressures of about 10–70 psig and coke drum temperatures of about 780°–840° F.

Advantages of the process of the present invention include a high degree of conversion of reactive, olefinic and diolefinic components of the pyrolysis naphtha by contact with free radicals generated in the coking process. Additionally, any gum, high molecular weight polymers, and/or coke formed as a result of converting the reactive olefinic and diolefinic components of the pyrolysis naphtha are accumulated within the coke formed from cracking the residuum charge stock in the coke drum. These and other advantages of the present invention will be more fully discussed in the detailed description of the invention which follows.

DETAILED DESCRIPTION OF THE INVENTION

Pyrolysis naphtha charge stocks within contemplation of the present invention are those obtained from pyrolitic cracking conditions. Such pyrolysis naphthas are highly unsaturated, comprising aromatic, polynuclear aromatic, olefinic, diolefinic, olefin substituted aromatic, etc., hydrocarbons. Such pyrolysis naphthas are unstable and upon addition of heat, diolefinic and styrene compounds present therein tend to polymerize forming gum, high molecular weight polymers, and coke. As a consequence, untreated pyrolysis naphtha when charged to refining processes such as hydrogenation processes tend to foul and/or plug process equipment and to deactive catalyst. A common source of pyrolysis naphtha is steam cracking of hydrocarbons for production of low molecular weight olefins such as ethylene. In such steam cracking processes, charge stock hydrocarbon at low pressure in the presence of steam is heated to a high temperature for a short time whereupon the hydrocarbon charge stock is cracked substantially into low molecular weight olefins, particularly ethylene. A byproduct of such steam cracking processes is pyrolysis naphtha which generally comprises about 70–90 percent or greater aromatic nuclei containing hydrocarbons with the remainder of the pyrolysis naphtha essentially comprising olefin and diolefin hydrocarbons. Charge stocks to a steam cracking process may vary from ethane through gas oils. Although pyrolysis naphtha is a byproduct of all such steam cracking processes, more pyrolysis naphtha is produced from processes employing the heavier hydrocarbon charge stocks. In the method of the present invention, pyrolysis naphthas obtained as byproducts from steam cracking processes are contemplated to be the major charge stocks. However, any naphtha boiling range hydrocarbon containing substantial amounts of reactive olefinic or diolefinic hydrocarbons may be processed according to the method of this invention.

Residuum charge stocks with which pyrolysis naphtha may be treated in the process of the present invention include those residuum stocks which are amenable to delayed coking. For example, atmospheric residuum, vacuum residuum, tar sand residuum, shale oil, reduced crudes, cracked tar, heavy catalytic oils, asphalts and other heavy black oils suitable for the production of petroleum coke.

Delayed coking processes are well known in the petroleum refining industry. In such processes residuum hydrocarbon charge stocks are subjected to thermal cracking conditions for prolonged periods to produce increased yields of gas oil and naphtha. In such delayed coking processes, residuum hydrocarbon is charged to a furnace wherein it is heated to a temperature of from about 800°–1050° F, and preferably about 900°–940° F such that the residuum acquires the heat for cracking. As a substantial portion of such residuum may become vaporized in the furnace, pressure drops through said furnace may range from about 200–2000 psi. From the furnace the heated residuum is introduced into an insulated coke drum wherein residence time is sufficient for coke to form and settle from the mixture. In the coke drum operating conditions include temperatures of from about 700°–900° F, preferably about 780°–840° F, and pressures of about 10–17 psig. Vapors from the coke drum comprising dry gas, naphtha and gas oil are recovered for subsequent processing. Generally, such vapors are fractionated to yield fractions useful in subsequent refining processes, such as a gas fraction, a naphtha fraction for gasoline blending or aromatic extractions and a gas oil fraction. Generally, heavier liquid materials are maintained in the coke drum for a cycle of about 12–24 hours for cracking into lighter hydrocarbons and coke. However such heavier liquid may be recycled to the furnace for application of additional heat. When coke builds up to a predetermined level in one of the coke drums, the process cycle is terminated and flow is generally converted to another drum so the furnace operation may be continuous. Thus coke drums are operated in pairs with one on stream while the other is being dumped. A full coke drum is removed from the process flow, stream is injected to strip light hydrocarbons from the coke, and the coke is cooled by water injection. Upon cooling, coke is removed from the drum by means such as high pressure water jets which cut the coke into small particles and wash these particles from the drum. Product distribution from coking processes may vary widely depending upon whether naphtha is to be produced during the coking operation or during subsequent cracking of coker gas oils. Naphtha yields from coking residuum charge stocks may vary from 5 to 25 volume percent of the residuum charge to the coking unit.

In the process of the present invention, pyrolysis naphtha may comprise up to about 20 volume percent of the hydrocarbon charge to the delayed coking process. However, it is preferred that pyrolysis naphtha comprise about 10 volume percent or less of the delayed coking process charge. As a major portion of the pyrolysis naphtha leaves the coking process as vapor, pyrolysis naphtha charge rates exceeding about 20 volume percent of the delayed coking process charge may produce more vapor than the coking process is designed to handle, thus resulting in unit upsets and pressure increases within the coke drum.

Pyrolysis naphtha may be charged to the delayed coking process at the furnace inlet, or may be charged directly to the coke drum. When pyrolysis naphtha is charged to the furnace inlet, preferably the pyrolysis naphtha should comprise no more than 10 volume percent and preferably 5 volume percent or less of the delayed coking process charge. As pyrolysis naphtha contains substantial amounts of unstable hydrocarbons, application of heat tends to encourage formation of gums, high molecular weight polymers, and coke. Should the pyrolysis naphtha charge exceed about 10 volume percent of the charge to the coking furnace, substantial amounts of these high molecular weight hydrocarbons may deposit upon the furnace tubes causing coke accumulations and reduced furnace efficiencies. Consequently, it is desirable that about 90 volume percent or more of the charge to the furnace comprise residuum charge stocks which will entrain the high molecular weight hydrocarbons formed as a result of heating the pyrolysis naphtha and prevent their deposition upon the furnace tubes.

Whether charged to the furnace inlet or directly to the coke drum, pyrolysis naphtha may deposit high molecular weight hydrocarbons (coke) at the point of injection or in the pyrolysis naphtha charge line should the naphtha be heated to elevated temperatures. Consequently, care should be taken to maintain the pyrolysis naphtha charge to a temperature less than about 500° F up to its injection into the delayed coking process. Cooling means, such as water jackets on the process charge line, may be employed to maintain the pyrolysis naphtha at a desired low temperature. Cold naphtha, however, when charged to a delayed coking process absorbs a substantial amount of heat which would otherwise be available for cracking the residuum charge. In U.S. Pat. application Ser. No. 535,315, filed Dec. 23, 1974 it is disclosed that pyrolysis naphtha in admixture with water may be heated to temperatures of about 700° F at elevated pressures without substantial formation of gums, high molecular weight polymers, or coke. Therefore, it is within the contemplation of the present invention that pyrolysis naphtha and water in a naphtha water ratio of from about 0.5:1 to about 3:1 may be charged to a delayed coking process. By this means deposition of high molecular weight hydrocarbons at the point of injection or in the naphtha charge line may be avoided and the pyrolysis naphtha may be heated to a temperature of about 700° F prior to the introduction into the delayed coking process. Water, under temperature and pressure conditions of a delayed coking process forms substantial volumes of vapor. Consequently, when water is admixed with pyrolysis naphtha charge to a delayed coking process it is preferable that such pyrolysis naphtha-water mixture comprise about 10 volume percent or less, and preferable 5 volume percent or less, of the total charge volume to the delayed coking process.

As hereinabove stated, pyrolysis naphtha is a liquid hydrocarbon comprising about 70–90 percent aromatic hydrocarbons and containing substantial amounts of unstable, reactive components such as diolefins, styrenes, etc. Thus, although pyrolysis naphtha is a valuable source of aromatic hydrocarbons for gasoline blending or for chemical use, saturation of reactive dienes must be accomplished. According to the process of the present invention, charging pyrolysis naphtha to a delayed coking process wherein the residuum hydrocarbon is being coked results in conversion of reactive components of the pyrolysis naphtha without substantial conversion of aromatic components. Treated pyrolysis naphtha from the coking unit is recovered along with coker naphtha for further processing such as gasoline blending or hydrogenation prior to aromatic extraction. The present invention is based upon the fact that under pressure-temperature conditions of a delayed coking process, the concentration of free radicals is high. This high concentration of free radicals induces condensation, splitting and cracking reactions, and under these conditions unstable components of the pyrolysis naphtha are converted to more stable compounds.

The following examples are included to demonstrate the effectiveness of the treating method of the present invention for reducing unstable olefinic and diolefinic unsaturation of pyrolysis naphtha and for producing a product naphtha suitable for further refinery processing. These examples are for illustration only and are not to be considered as limiting the scope of the present invention, which is set out in the appended claims.

EXAMPLE I

In this example, a series of batch coking runs were made in a 1500 milliter autoclave wherein a commercial vacuum residuum was coked under operating conditions similar to those employed in commercial delayed coking units. In these runs commercial and synthetic blends of pyrolysis naphthas were charged to the autoclave along with the vacuum residuum for a determination of the effectiveness of this process for reducing reactive olefinic unsaturation of the pyrolysis naphtha. Analyses of products from these coking runs were made to determine the degree of conversion of unstable olefinic hydrocarbons in the pyrolysis naphtha.

Analyses of charge stock vacuum residuum, pyrolysis naphtha, and two synthetic blends of pyrolysis naphtha with pure diolefin hydrocarbons are shown in Table 1, following.

TABLE 1

CHARGE STOCK ANALYSES

| | Vacuum Residuum | Pyrolysis Naphtha | Naphtha Blend No. 1 | Naphtha Blend No. 2 |
|---|---|---|---|---|
| Gravity, ° API | 6.4 | 34.5 | — | — |
| Carbon Residue, wt. percent | 22 | 2.5 | — | — |
| Sulfur, wt.% | 3.8 | .005 | — | — |
| Viscosity, SUS at 210° F | 7656 | — | — | — |
| Penetration No. | 100 | — | — | — |
| Vol.% Pyrolysis Naphtha | 0 | 100 | 86.7 | 73.4 |
| Vol.% 1,7 Octadiene | 0 | 0 | 13.3 | 13.3 |
| Vol.% 1,5 Hexadiene | 0 | 0 | 0 | 13.3 |
| FIA Analysis | | | | |
| Aromatic, Vol.% | — | 93.5 | 81.1 | 68.6 |
| olefins, vol. % | — | 6.5 | 18.9 | 31.4 |
| Saturates, vol.% | — | 0 | 0 | 0 |
| Diene No. | — | 6.0 | 6.1 | 6.1 |
| Bromine No. | — | 80 | 99 | 134 |

Operating conditions and analytical results of experimental coking runs 1-6 are shown in Table 2, following.

TABLE 2

COKING RUNS WITH PYROLYSIS NAPHTHA

| Run No. | 1 | 2 | 3 | 4 | 5 | 6 |
|---|---|---|---|---|---|---|
| Charge to Autoclave | | | | | | |
| Vacuum Residuum, gm | 500 | 500 | 502 | 500 | 500 | 500 |
| Pyrolysis, naphtha, gm | 0 | 50 | 0 | 50 | 0 | 0 |
| Naphtha Blend, ml | 0 | 0 | 0 | 0 | 50 | 50 |
| Coke, gm | 0 | 0 | 100 | 100 | 0 | 0 |
| Process Conditions | | | | | | |
| Temp, ° F | 800 | 800 | 818 | 818 | 800 | 800 |
| Press, psig | 1700 | — | 1725 | 2000 | 1525 | 1600 |
| Residence time, hr. | 1 | 1 | 0.5 | 0.5 | 1 | 1 |
| Products | | | | | | |
| Gas, gm | 40 | 22.3 | 44 | 31 | — | — |
| Liquid, gm | 192 | 503 | 192 | 226 | 190 | 205 |
| Coke, gm | 224 | 503 | 328 | 353 | 247 | 249 |
| IBP-350° F Fraction | | | | | | |
| Bromine No. | 22.7 | 12.6 | 27.5 | 20.8 | 19.5 | 19.3 |
| IBP-350° F Fraction | | | | | | |
| Diene No. | 0.9 | 0.8 | 0.9 | 1 | 0.9 | 0.6 |
| FIA Analysis | | | | | | |

TABLE 2-continued

| COKING RUNS WITH PYROLYSIS NAPHTHA | | | | | | |
|---|---|---|---|---|---|---|
| Run No. | 1 | 2 | 3 | 4 | 5 | 6 |
| Charge to Autoclave | | | | | | |
| Aromatic, vol.% | 13.0 | 33.0 | 12.5 | 27.5 | — | — |
| Olefins | 8.0 | 4.0 | 9.5 | 5.5 | — | — |
| Saturates | 79.0 | 53.0 | 78 | 67 | — | — |

In considering results from the six coking runs shown in Table 2, the principle measures of treated naphtha quality are Diene number and Bromine number. High Diene numbers are indicative of high concentrations of reactive conjugated double bonds. Consequently, a reduction in Diene number indicates a reduction in the concentration of such conjugated double bonds. The Bromine number is indicative of the total olefinic unsaturation of a naphtha, and a decrease in Bromine number indicates a reduction in olefinic unsaturation. The Bromine number of naphtha is determined by ASTM Standard Test D-1159. The Diene number is determined by reacting a known amount of maleic anhydride with a hydrocarbon sample, then back titrating with a standard base to determine the amount of maleic anhydride which has reacted. The maleic anhydride reacts with compounds having reactive conjugated double bonds such as conjugated diolefins, styrenes, etc., to form an adduct, but does not react with cumulative or isolated double bonds. However, since conjugated double bonds are more stable than cumulative or isolated double bonds, a demonstration that the number of conjugated double bonds has been reduced is considered to be sufficient as an indication that more reactive cumulative and isolated double bonds have likewise been reduced.

The goal of the process of the present invention is to reduce the number of reactive olefinic and diolefinic bonds in the naphtha product. Runs 1 and 2 of Table 2 are comparative delayed coking runs. Run 1 is a delayed coking run charging only vacuum residuum. In Run 2, pyrolysis naphtha was charged along with vacuum residuum. At the end of each run naphtha fractions having a 350° F end point were recovered from the product of the autoclave by fractional distillation. The recovered naphtha fractions were tested for Diene number and Bromine number. From Table 2, it is seen that the Diene number of the naphtha fractions from both Runs 1 and 2 are less than 1 which compares with a Diene number of 6.0 for pyrolysis naphtha charged, as shown in Table 1. Thus, it is seen that naphtha product of Run 2, wherein pyrolysis naphtha and vacuum residuum were subjected to delayed coking conditions, is of substantially reduced diene number compared to untreated pyrolysis naphtha. Additionally, Bromine number of the naphtha product from Run 2 wherein pyrolysis naphtha was included in the charge, is substantially lower than the Bromine number of Run 1 where only vacuum residuum was subjected to coking conditions. Thus, total olefinic unsaturation is lower for the naphtha product of Run 2 than for Run 1, indicating a more stable product from Run 2. Also comparing aromatic content of naphthas recovered in Runs 1 and 2 demonstrates that substantially more aromatics were recovered in Run 2 wherein pyrolysis naphtha was included in the coking process charge, as compared to aromatic content of naphtha from Run 1.

Comparative Runs 3 and 4 were made in the presence of coke particles, a condition normally encountered in a commercial delayed coking operation. In Run 3, 500 grams vacuum residuum was charged and in Run 4, 500 grams vacuum residuum and 50 grams pyrolysis naphtha were charged. Analyses of the product naphthas of Runs 3 and 4 again indicate very low Bromine numbers and Diene numbers for such naphthas, indicating conversion of reactive Diene and other olefins. As in Runs 1 and 2 Bromine numbers of naphtha product of Run 4, wherein pyrolysis naphtha was included in the charge stock, is lower than Bromine number of the naphtha product in Run 3 wherein no pyrolysis naphtha was present. Also, aromatic content of the naphtha of Run 4 is substantially higher than aromatic content of Run 3.

Runs 5 and 6 were made to demonstrate the effectiveness of the process of the present invention for converting isolated Dienes which conversion is not indicated by the Diene number determination. In Run 5, a blend of pyrolysis naphtha and 1,7 octadiene (naphtha blend number 1 of Table 1) was made, and the Bromine number and Diene number determined. From Table 1, it is seen that upon addition of the 1,7 octadiene to pyrolysis naphtha the Bromine number increased from 80 to 99 while the Diene number remained essentially unchanged at 6.1. In Run 5, 500 grams vacuum residuum and 50 grams of naphtha blend No. 1 were subjected to the coking process and the product naphtha fraction recovered by fractional distillation. As can be seen in Run 5 of Table 2, Bromine number of the naphtha product was reduced to 19.5 which is comparable with results of Runs 2 and 4 of Table 2. Additionally, the Diene number was reduced to less than 1. Thus the results of Run 5 demonstrate that the process of the present invention is effective for converting isolated double bonds as well as conjugated double bonds.

Run 6 was made to confirm the results of Run 5. A second blend (naphtha blend No. 2), comprising pyrolysis naphtha, 1,7 octadiene and 1,5 hexadiene, having a Bromine number of 134, was made. In Run 6, 500 grams vacuum residuum and 50 grams naphtha blend No. 2 were coked in the coking process and the naphtha product recovered by fractional distillation. Analysis of this product naphtha showed a Bromine number of 19.3, comparable to results obtained in Runs 2, 4 and 5 and thus further demonstrating that the isolated Dienes of the naphtha blend No. 2 were converted in the coking process. Additionally, the Diene number was reduced to about 0.6 indicating good conversion of conjugated Dienes also.

The aromatic content of naphthas obtained in Runs 2 and 4 of Table 2 increased over aromatic content of naphthas from Runs 1 and 3. This increase in aromatic content of the product naphthas of coking processes wherein pyrolysis naphthas was included in the charge demonstrate that aromatics present in the pyrolysis naphtha charge to the coking process were not destroyed under coking conditions, but rather were recovered as components of the coker naphtha product.

Thus, as can be seen from the preceding discussion and examples, treatment of pyrolysis naphtha in the presence of residuum hydrocarbon under delayed coking conditions results in production of a product naphtha substantially reduced in unstable olefinic and diolefinic unsaturation. Additionally, aromatic hydrocarbons present in the pyrolysis naphtha charge are not substantially converted to less desirable material. From the above description and examples, many modifications and variations of the process of this invention will be obvious to those skilled in the art. All such variations and modifications are considered to be included in the present invention and no limitations other than those contained in the appended claims are intended or implied.

We claim:

1. A process for reducing reactive olefinic and diolefinic unsaturation of pyrolysis naphtha, which process comprises:

a. mixing pyrolysis naphtha with water in a liquid volume ratio of from about 0.5/1 to about 3/1 pyrolysis naphtha to water;

b. mixing the pyrolysis naphtha-water mixture of step (a) with residuum oil to form a pyrolysis naphtha-water-residuum oil mixture comprising not more than about 10 liquid volume percent pyrolysis naphtha-water mixture;

c. treating the pyrolysis naphtha-water-residuum oil mixture of step (b) at conditions for delayed coking of said residuum oil; and d. recovering a naphtha product fraction, substantially free of reactive olefinic and diolefinic unsaturation from treating step (d).

2. The process of claim 1 wherein treating step (c) comprises:

e. heating said pyrolysis naphtha-water-residuum oil mixture, in a furnace zone, to a temperature in the range of about 800°–1050° F; and f. maintaining effluent from said furnace zone, in a delayed coking zone, at a temperature in the range of 700°–900° F, at a pressure in the range of 10–70 psig for a period to allow coke to form and settle.

3. The process of claim 2 wherein the pyrolysis naphtha-water mixture of step (a) is heated to a temperature in the range of 500°–700° F prior to mixing with residuum oil in step (b).

4. The process of claim 3 wherein the pyrolysis naphtha-water mixture comprises not more than 5 liquid volume percent of the pyrolysis naphtha-water-residuum oil mixture.

5. The process of claim 4 wherein naphtha recovery step (d) comprises:

g. recovering a vapor product comprising gas, naphtha, and gas oil boiling range hydrocarbons from said delayed coking zone; and h. fractionally distilling said vapor product for recovery of naphtha fraction substantially free of reactive olefinic and diolefinic unsaturation.

6. The process of claim 1 including;

i. heating said residuum oil, in a furnace zone, to a temperature in the range of 800°–1050° F;

j. heating said pyrolysis naphtha-water-mixture to a temperature in the range of 500°–700° F;

k. mixing hot residuum oil from step (i) with hot pyrolysis naphtha-water mixture from step (j); and l. maintaining the pyrolysis naphtha-water-residuum oil mixture, in a delayed coking zone, at a temperature in the range of about 700°–900° F, at a pressure in the range of about 10–70 psig, for a period to allow coke to form and settle.

7. The process of claim 6 wherein the pyrolysis naphtha-water mixture comprises not more than 5 liquid volume percent of the pyrolysis naphtha-water-residuum oil mixture.

8. The process of claim 7 wherein naphtha recovery step (d) comprises:

m. recovering a vapor product comprising gas, naphtha, and gas oil boiling range hydrocarbons from said delayed coking zone; and n. fractionally distilling said vapor product for recovery of a naphtha fraction substantially free of reactive olefinic and diolefinic unsaturation.

* * * * *